US005453613A

United States Patent [19]

Gray et al.

[11] Patent Number: 5,453,613

[45] Date of Patent: Sep. 26, 1995

[54] MASS SPECTRA INTERPRETATION SYSTEM INCLUDING SPECTRA EXTRACTION

[75] Inventors: Zachary A. Gray, Palo Alto; Roger H. Abel, Cupertino, both of Calif.

[73] Assignee: Hewlett Packard Company, Palo Alto, Calif.

[21] Appl. No.: 327,166

[22] Filed: Oct. 21, 1994

[51] Int. Cl.[6] ..... H01J 49/00

[52] U.S. Cl. ..... 250/281; 250/282

[58] Field of Search ..... 250/281, 282; 364/498

[56] References Cited

U.S. PATENT DOCUMENTS

| | | | |
|---|---|---|---|
| 5,072,115 | 12/1991 | Zhou et al. | 250/281 |
| 5,175,430 | 12/1992 | Enke et al. | 250/282 |
| 5,247,175 | 9/1993 | Schoen et al. | 250/281 |

OTHER PUBLICATIONS

Biller, J., et al. "Visible Fluorescence Emission Spectra", Analytical Letters, 7(7):515–529 (1974).

Dromey, R. G., et al., "Extraction of Mass Spectra Free of Background and Neighboring Component Contributions from Gas Chromatography/Mass Spectrometry Data", Analytical Chemistry, 48(9):1368–1375 (1976).

Colby, B. N., "Spectral Deconvolution for Overlapping GC/MS Components", Am. Soc. for Mass Spectrometry, 3:588–562 (1992).

*Primary Examiner*—Jack I. Berman

[57] ABSTRACT

A mass spectral analyzer system providing automated discovery, deconvolution and identification of mass spectrum is taught. Conventionally acquired mass data files are re-sorted from chronological to primarily ion-mass order and secondarily to chronological order within each ion-mass grouping. For each ion-mass measured, local peaks or maximums are identified through an integrator means. All local maximums are then sorted and partitioned such that a set of deconvoluted spectra is obtained such that each element of the set constitutes an identifiable compound. Compounds are then matched to reference spectra in library datafiles by conventional probabilistic matching routines.

3 Claims, 14 Drawing Sheets

MASS SPECTRA INTERPRETATION SYSTEM INCLUDING SPECTRA EXTRACTION

FIELD OF INVENTION

This invention relates to interpretation of mass spectra, in particular to a system which provides for the deconvolution of mass-charge signal of closely eluted compounds.

BACKGROUND

Mass spectrometric analysis of chromatographic results often fails to distinguish two or more components eluted with retention times so close that the total ion current trace appears as a single peak. This situation is common in the analysis of wastewater, hazardous waste, and organic tissue samples. Manual interpretation of such spectra is impossible, as even the most skilled operator is faced with a task that resembles that of finding the proverbial needle in a haystack. Library search programs are of limited utility for much the same reason.

A commonly used algorithm (termed Biller-Biemann, after its originators) provides a routine for the analysis of overlapping spectra components. (See Biller, J. Biemann, K. Anal Letters 1974, 7, 515). A spectrum is generated which incorporates mass/intensity pairs only from those mass to charge ratios which have mass chromatogram maxima at or adjacent to the selected scan. Thus, if two components have no common mass to charge ratios and they can be separated by two or more scans, distinct spectra can be generated for each component. Although this algorithm is simple to implement, the results are of limited utility due to insufficient resolution.

Arguably more powerful than Biller-Biemann is an algorithm suggested by Dromey (Dromey, R. G.; Stefik, M. J.; Rindfleisch, T. C.; Duffielk, A. M. Anal. Chem. 1976, 48, 1365) which bases the analysis of peaks on the concept that all peaks for a single component will have the same shape. However, commercial implementation of this algorithm has yet to be successful.

Alternatively, Colby, in "Spectral Deconvolution for Overlapping GC/MS Components" *J Am Soc Mass Spectrom* 1992, 3,558–562, reports a deconvolution algorithm which attempts to extend the Biller-Biemann algorithm to allow assessment of peak shape yet retain simplicity sufficient for commercial applications. However, none of the methods reported to date finds all possible components in a data file, thoroughly deconvolutes spectra, or functions automatically. It is clear from the foregoing that a simple, effective, and automatized means for distinguishing between closely eluted analytes in GC/MS analysis is much needed.

SUMMARY

The present invention provides for a system for automated generation, deconvolution and identification of mass spectra. Briefly, a conventionally acquired mass data file is re-sorted from chronological order to primarily ion-mass order and secondarily to chronological order within each ion-mass grouping. For each ion-mass measured, local peaks or [maximums] maxima are identified through an integrator [means] device. All local [maximums] maxima are then sorted and partitioned such that a set of deconvoluted spectra is obtained such that each element of the set constitutes an identifiable compound. Compounds are then matched to reference spectra in library datafiles by conventional probabilistic matching routines.

DETAILED DESCRIPTION OF THE INVENTION

Introduction

In order to best convey the advantages of the present invention, it is necessary to present a brief overview of mass spectrometry, and a typical spectral analysis technique, followed by a description of the invention, and then examples of the superior results the invention provides.

Mass spectrometry is well known as to its usefulness in the identification of compounds as well as the determination of molecular structure. Briefly, a mass spectrometer receives a sample in gas or liquid state which sample is partially ionized by any of a variety of means. For each compound in the sample, fragment ions are typically formed, each fragment ion having a particular mass to charge ratio. Mass to charge ratio is expressed as m/e, where m equals the mass of the ion in atomic mass units and e is the charge of the ion, where the charge results from the loss of electrons via the ionization process. The mass to charge ratio, m/e, is commonly referred to as "mass".

Next, ions are separated through the use of fields, electric, magnetic or both, into groupings according to mass. Typically, ions of a single mass at a time are transmitted to a detector or electron multiplier for measurement or recording. The mass analyzer controls allow for pre-selecting a mass range over which m/e values are swept in a repetitive and continuous fashion. A plot or tabulation of ion intensity versus m/e is referred to as the "mass spectrum".

Figure 1:
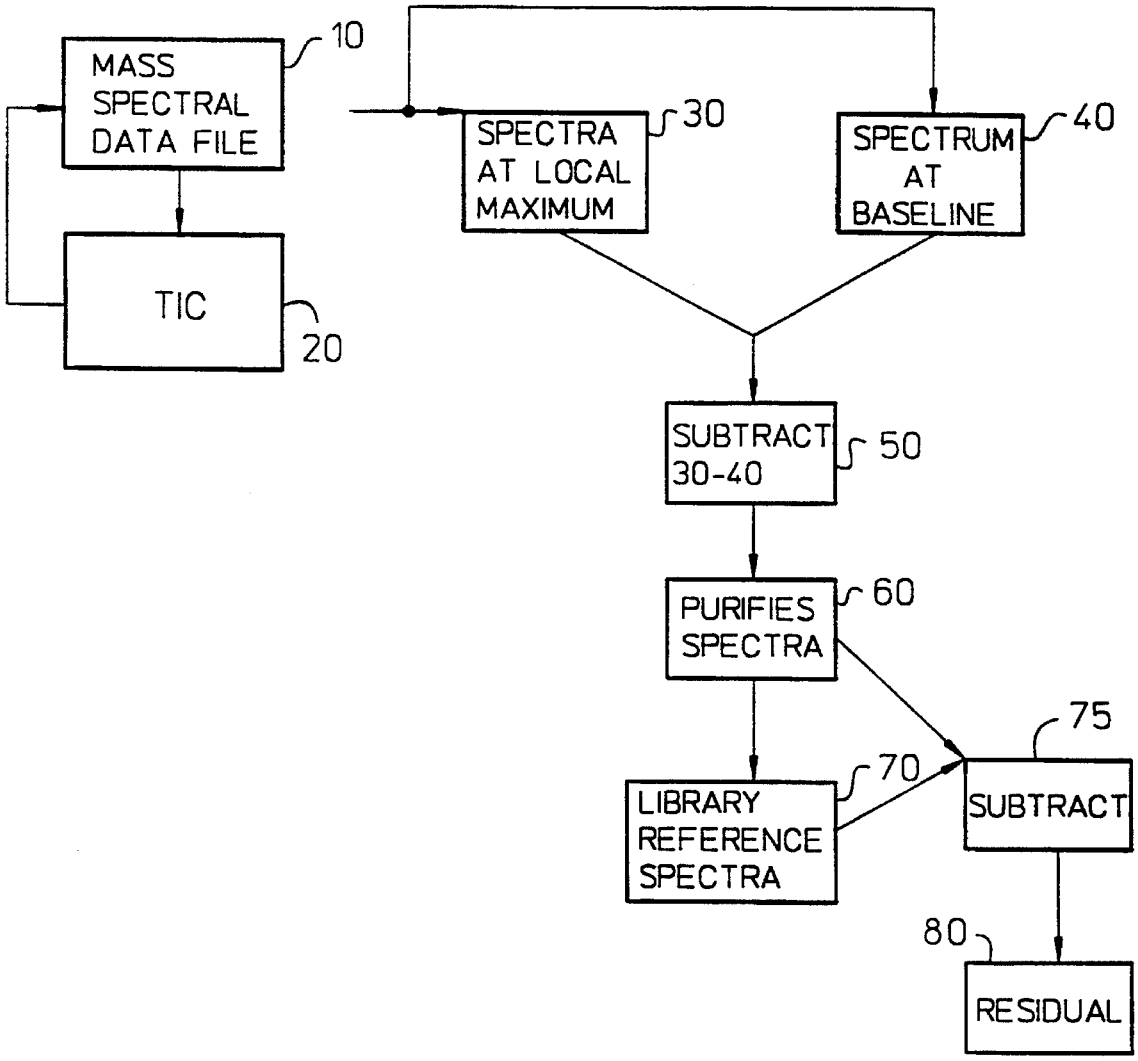
FIG. 1 is a block diagram of prior art mass spectrometer with typical peak extraction device.

FIG. 1 illustrates how the interpretation of mass spectra can provide sample compound identification. The mass spectra (ms) data file 10 of the sample under investigation can be matched, one spectrum at a time, against a library of sample spectra 70 of previously recorded pure or otherwise known compounds. The steps are well known, and generally consist of creating a display of total ion chromatograms (TIC) 20, locating local maxima (peaks) and baseline areas; returning to the ms data file 10, selecting two representative spectra, a spectrum at local maximum 30 and a spectrum at baseline or noise level 40. With respect to the two, the noise level 40 is subtracted 50 from the local maximum 30 to give the so-called purified spectrum 60. The library of sample spectra 70 is then searched in order to find a "match" for the sample spectrum. Sometimes a spectrum is matched by means of subtracting the reference spectrum from the sample 75, the result of which is a "match" plus a residual spectrum 80. The residual spectrum 80 may then itself be searched for in the library of sample spectra 70.

This invention provides a superior means of handling sample data so that many of the insensitivities of prior matching protocols are overcome. Manual analysis is only possible when features of the spectrum suggest the possible identity of the compounds under investigation. In the case of closely eluting compounds, it is often the case that the spectra give no visible indication of just how many and what type of compounds are contributing to the observed peak.

Samples to be analyzed by mass spectrometry may be introduced in gas or liquid form by means of the well-known gas chromatograph/mass spectrometer (GC/MS) or liquid chromatograph/mass spectrometer (LC/MS). After injection into the input end, the vaporized sample travels through the GC or LC column along with an inert gas toward a column. The column is packed with the liquid phase. Different compounds are slowed at different rates as the sample passes through the liquid phase and, as a consequence, emerge at different times. Under standard operating conditions, compounds have reproducible retention times (time from injection to elution). The eluted sample then passes into the mass spectrometer where the mass is determined.

The matching of the mass spectrum of the sample with reference spectra in a library has typically been performed by relying almost exclusively on chronological sorting of the mass spectra. The reference data contains spectra of retention times and spectra of compounds on an abundance versus time plot. The sample would be identified as to its components by the serial analysis of a single spectra at a time to produce, ultimately, a profile of the sample composition by virtue of the sum of the spectral analyses. As spectra were selected in chronological order for matching, the local maxima would be identified and the baseline areas located. Once these had been determined in the sample spectra, the background noise spectra was subtracted from the local maxima spectra. Then the library was searched, in an attempt to match the corrected or "purified" spectra with the known, characteristic spectra of compounds in the reference library. If a match were made but there were residual spectrum contributing to the pattern of the sample, the residual spectra were subtracted from the matching portion of the spectra. The procedure was repeated in attempts to match the residual spectrum with a closely eluting component not attributable to mere noise (i.e. artifacts of the electronics or background chemicals).

THE INVENTION

Figure 2:
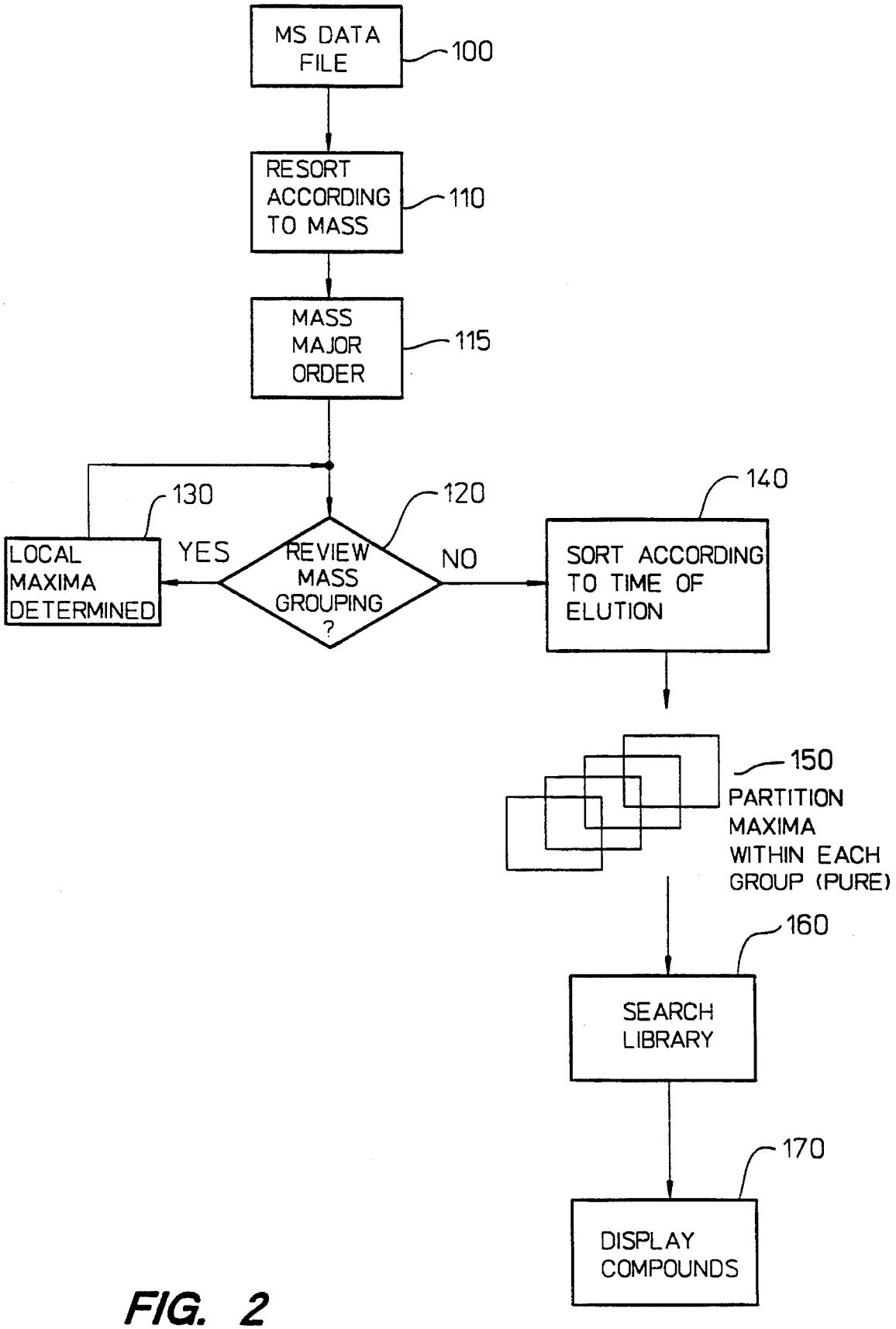
FIG. 2 is a block diagram of the current invention.

The invention provides for a novel and useful manner of and apparatus for performing the mass spectrometer data analysis. Initially, as depicted in FIG. 2, the entire mass spectra data file 100 for the sample is re-sorted 110 according to mass rather than time of elution. The mass spectra data file in mass major order 115 is then reviewed 120 according to mass groupings and local maxima 130 are determined according to accumulations within each mass grouping. Local maxima 130 within each grouping are then sorted 140 according to time of elution. All local maxima 130 within each grouping are partitioned in such a way that a set of "pure" spectra 150 result. Each spectrum which comprises an element of the set of spectra represents one distinct, identifiable compound. The reference library 160 is then searched for a match to the individual elemental spectrum in the typical probabilistic spectral matching protocol; compounds matched to reference spectra 170 are then displayed. The invention provides several key advantages over prior compound identification methods and systems. First, the invention provides for re-sorting according to mass which greatly enhances the system's capacity to distinguish between closely eluted compounds. Second, the inventive system is much more sensitive to mixtures of compounds with a significant noise factor. Third, the invention provides a unique and useful way to account for the fact that the scan from which the mass data is collected does not take place in a single instant but rather actually spans a detectable amount of time (from 0.1 to 1 second). The resorting from strictly chronological order to primarily ion-mass and secondarily chronological order greatly enhances the accuracy of the data analysis, most particularly in the case of closely eluted compounds. The manner in which signals are identified obviates the portion of mass spectrometric data analysis in prior art where the "noise" was subtracted. Noise was subtracted on the basis of the apparent difference from the highest (or strongest) identified signal. However, there was no certainty that what was being subtracted was, indeed, noise since there was no way to distinguish between noise and signal. In the invention presented herein, no subtraction is required since noise is effectively handled in a more sensitive manner. By the process of locating maxima and sorting and partitioning, the signals of lowest intensity (that arguably could be characterized as noise) merely "drop out" of the analysis as insignificant, leaving the identified maxima and the resultant element spectra intact for analysis. The invention provides an automated mass spectrometric system capable of analyzing a wide variety of chemical compounds, including those which are closely eluted. The invention also provides a method for analyzing mass spectrometric data that is capable of distinguishing closely eluted compounds. Thus, increased analytical power and greater ease of operation are provided by this invention in the area of mass spectrometric systems.

Figure 3:
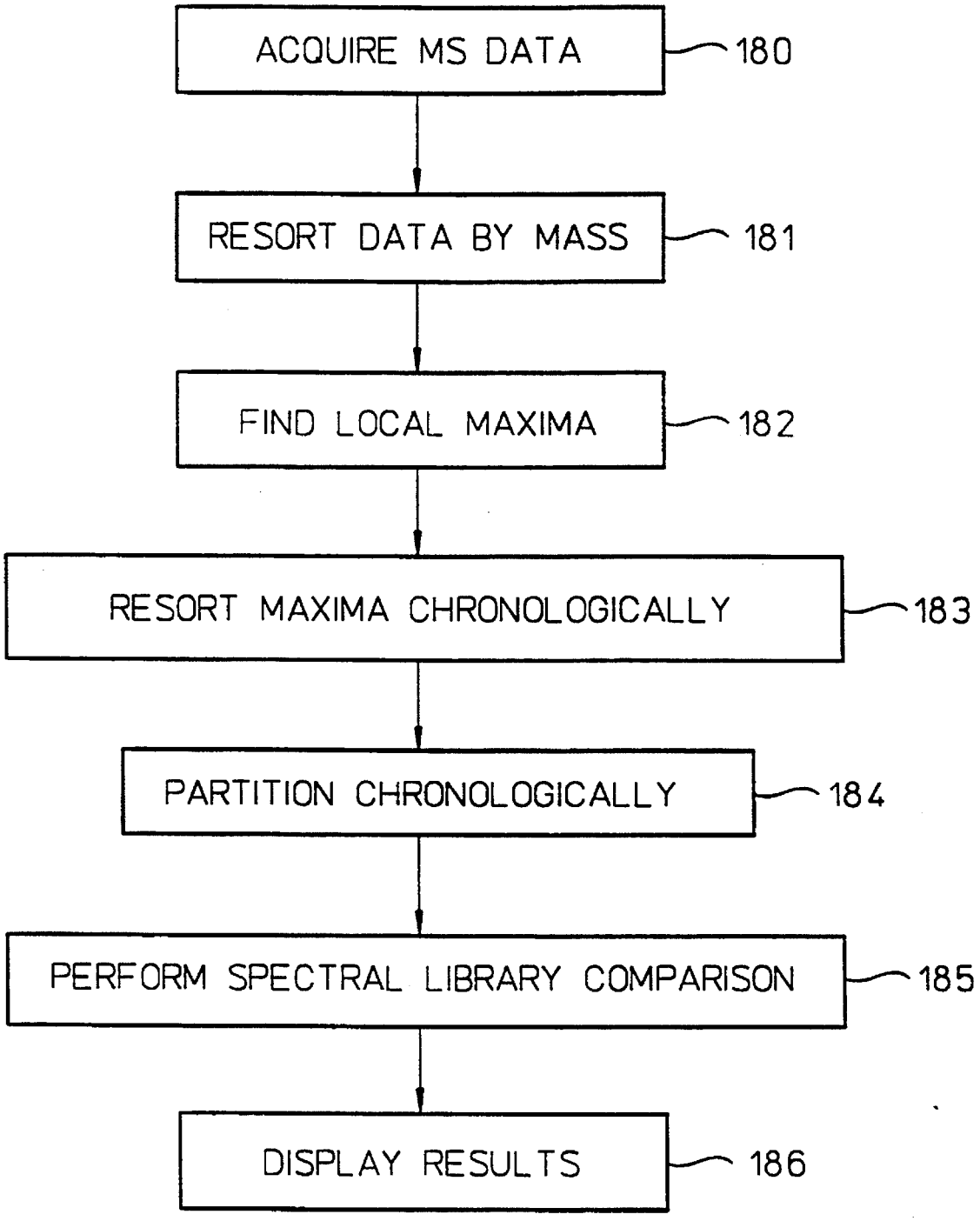
FIG. 3 is a schematic representation of the method of analysis according to the present invention.

FIG. 3 is a schematic representation of the method of analysis according to the present invention. The steps comprising the method are as follows: acquiring mass spectrometric data 180, re-sorting the mass spectrometric data by mass 181, finding local maxima 182, re-sorting maxima chronologically 183, partitioning chronologically 184, performing spectral library comparison 185, displaying results 186.

Figure 4:
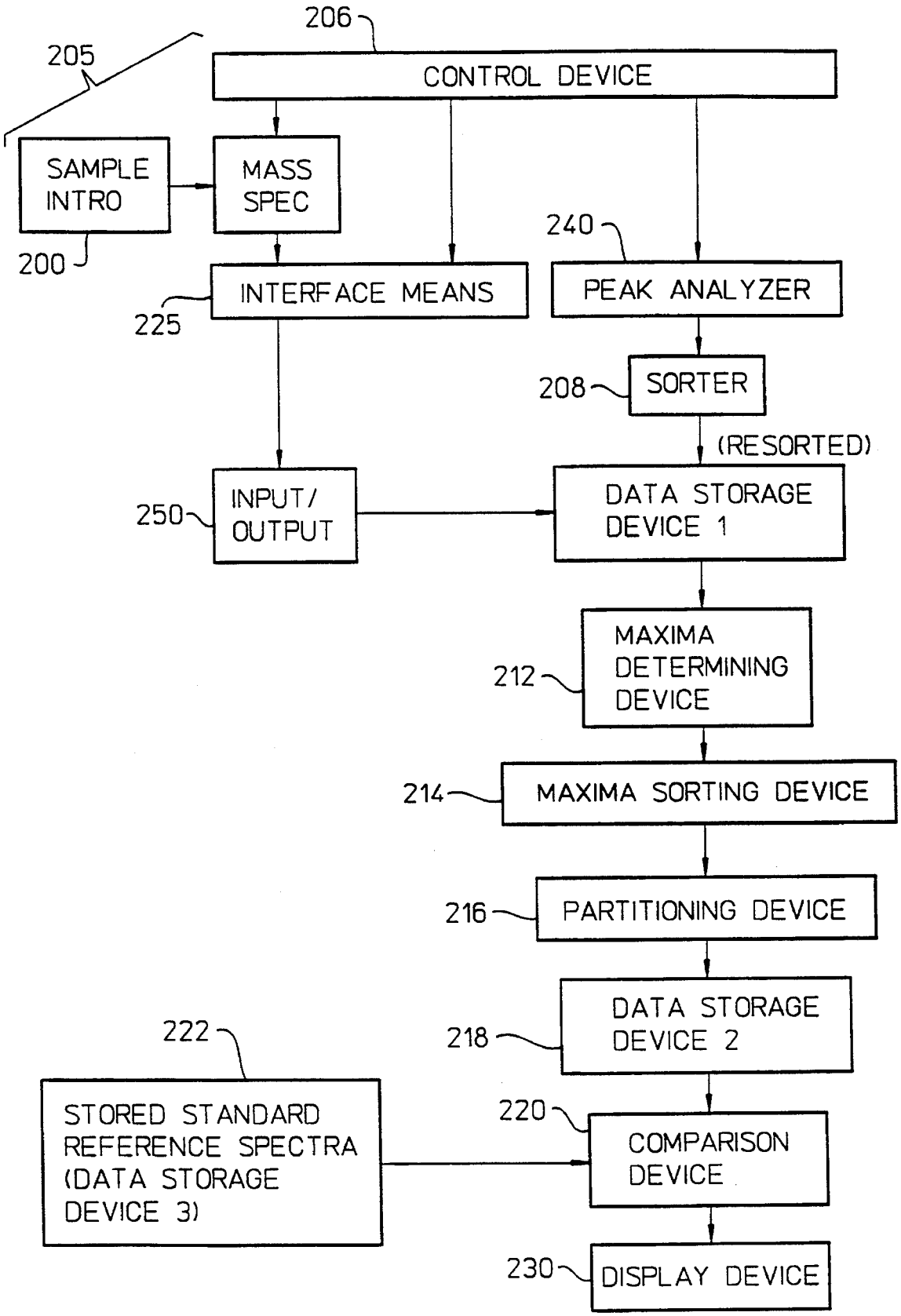
FIG. 4 is a functional block diagram of a spectrometric system according to the present invention.

FIG. 4 is a functional block diagram of a mass spectrometric system according to the invention. The invention provides a mass spectrometric system including a measuring device 205 operable for measuring the mass spectra of a sample which contains one or more compounds; a sample introduction device 200 by way of which the sample is introduced into the measuring device.

The measuring device 205 is controllable by a control device 206 so as to measure one or more mass peaks of the sample. A peak analyzer device 240 is electrically coupled to a data input/output device 250. The peak analyzer device 240 includes a sample data storage device (not shown), a re-sorting sample data device 208 operative to re-sort data from chronological order to, primarily, ion-mass order and secondarily to chronological order within each ion-mass grouping. Local ion abundance maxima within each mass grouping are found by a maxima determining device 212. All local ion abundance maxima identified by the determining means are then sorted chronologically by a maxima sorting device 214. All sorted local ion maxima are then partitioned by operation of a partitioning device 216 for the purpose of producing a set of deconvoluted spectra stored in a second data storage device 218. In deconvoluted spectra each element of the set represents a distinct compound. A comparison means 220 then operates to compare deconvoluted spectra with stored standard reference spectra stored in a third data storage device 222 such that deconvoluted spectra are matched to at least one reference spectra. The comparison device 220 then measures mass peaks to determine correspondence to mass peaks of the stored spectrum of the target compound on a probabilistic basis. The degree of matching is determined with respect to the spectral matching criterion. The comparison device 220 is electrically coupled to the second and third storage devices 218, 222 and to the control device 206; the target compound is identified as being present in the sample or as not being present according to the spectral matching criterion. The display device 230 receives output from the comparison device 220 and provides a visual representation of the results to the spectrometrist.

The deconvolution process comprises the steps of: calculating time centroids for each mass chromatogram maximum in the data range; resorting the mass spectral data file from chronological order to ion-mass order; selecting, by means of an integrator, local peaks (maximums) for each ion measured by the means for measuring mass spectra; sorting all local maximums; and partitioning all local maximums such that a set of spectra is obtained wherein each spectrum represents an identifiable compound.

The following configuration of equipment supports the operation of the invention.

An HP 5972 functionally connected to a gas chromatograph, (preferably an HP 5890 GC) which is, in turn, connected to a mass spectrometer, (preferably an HP5972 Mass Spectrometer). The GC and MS are connected to a computer and printer, in this case an HP Vectra PC compatible computer with an HP Laser Jet Printer. The computer must be capable of running the analysis according to the invention, in this case, HP G1034C Controlling Software and acquisition and control software/library and reference spectra.

EXAMPLES

The invention performs as well as other conventional methods in the analysis and identification of pure compounds. In, cases where the two components are widely enough separated that visual inspection indicates two components, the invention outperforms commonly used techniques. The invention automatically returns spectra that may also be selected manually by selecting the apex and leading shoulder. Very high quality library search results from the invention.

Figures 1, 5:
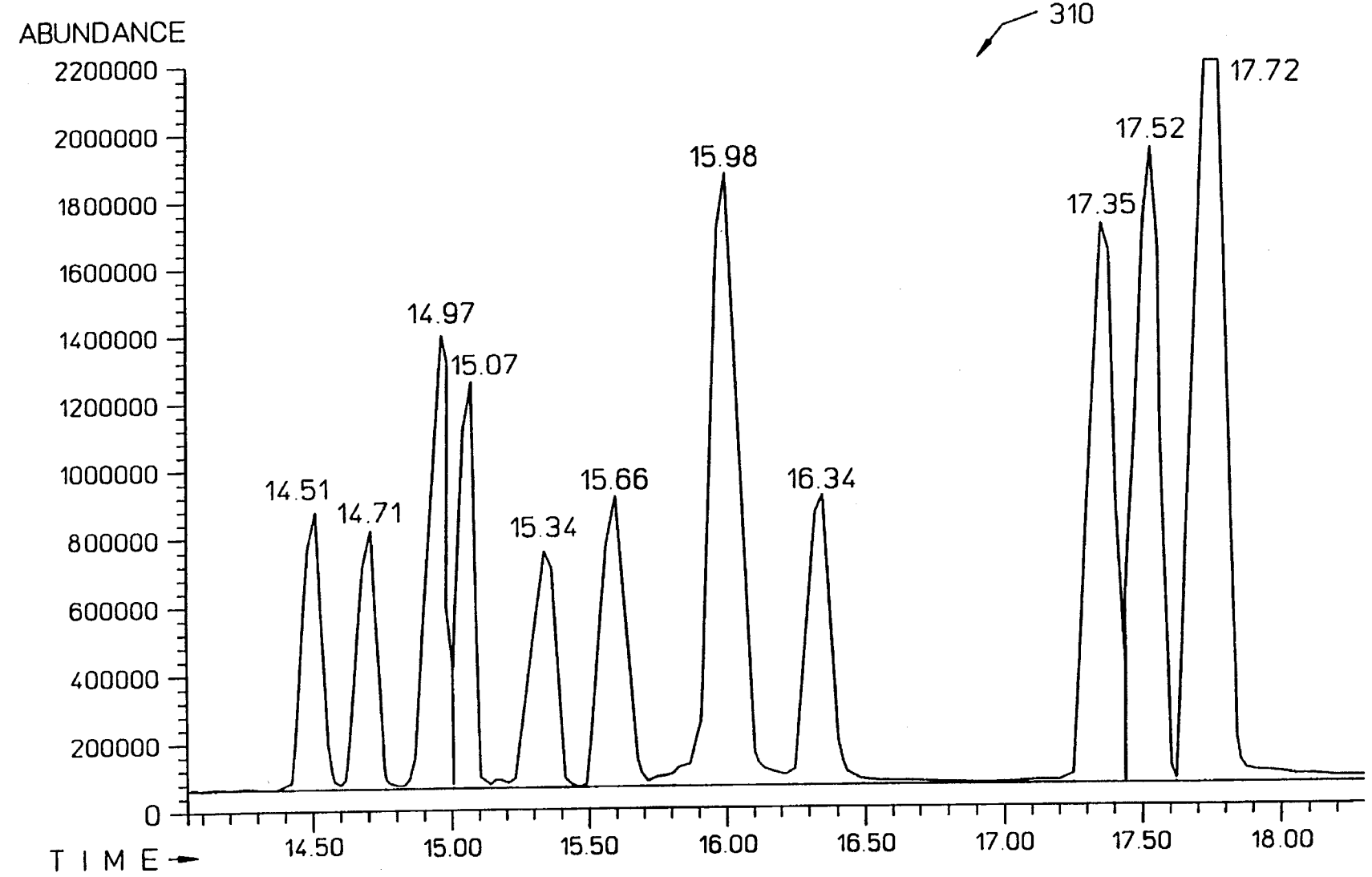
FIG. 5, including 5.1 through 5.10, shows the data from a sample analyzed by conventional means as compared with the analysis of the invention.
Figures 2A, 5:
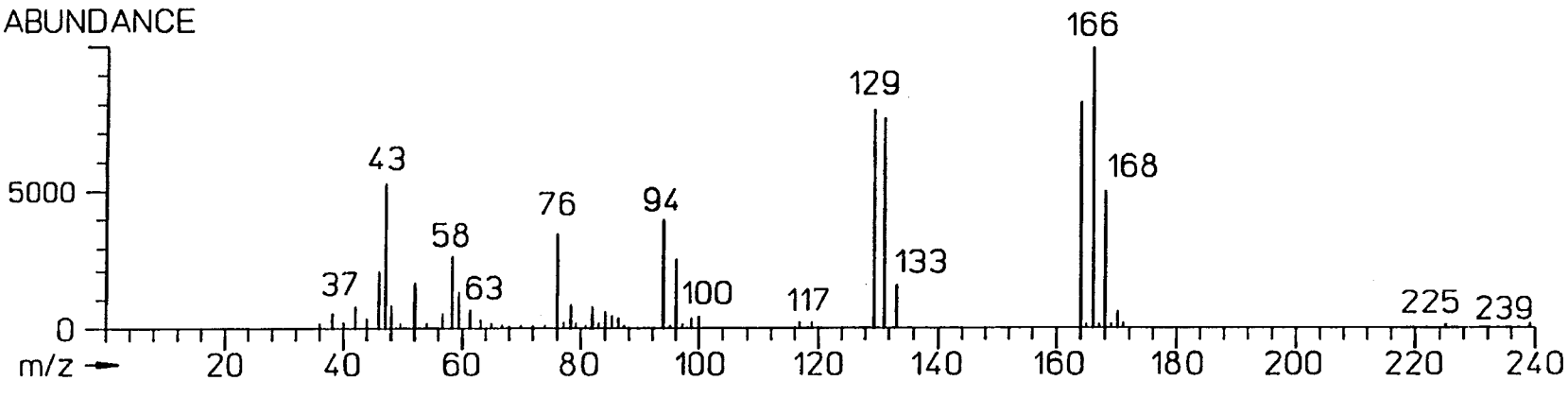
Figures 2B, 5:
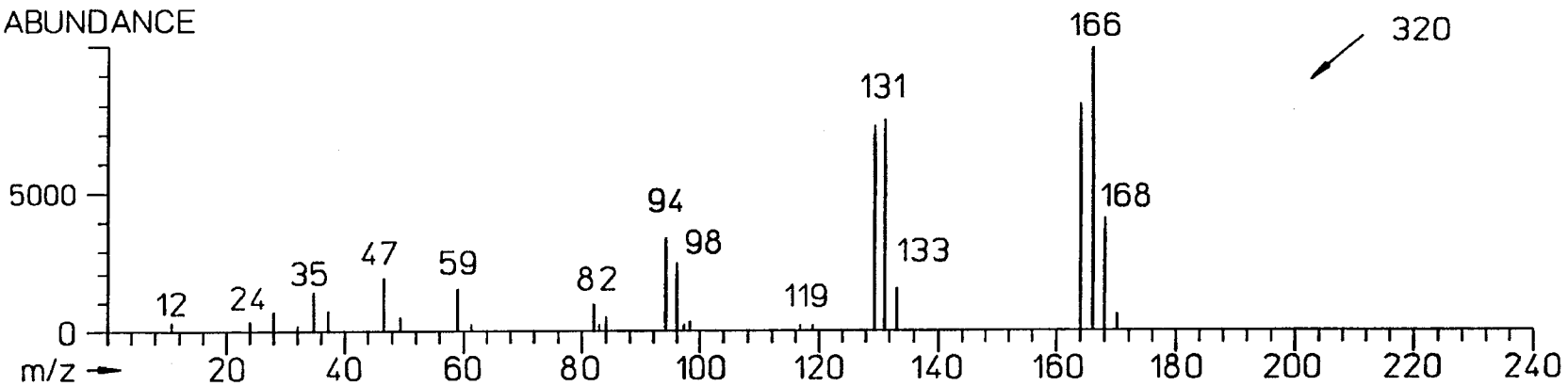
Figures 3, 5:
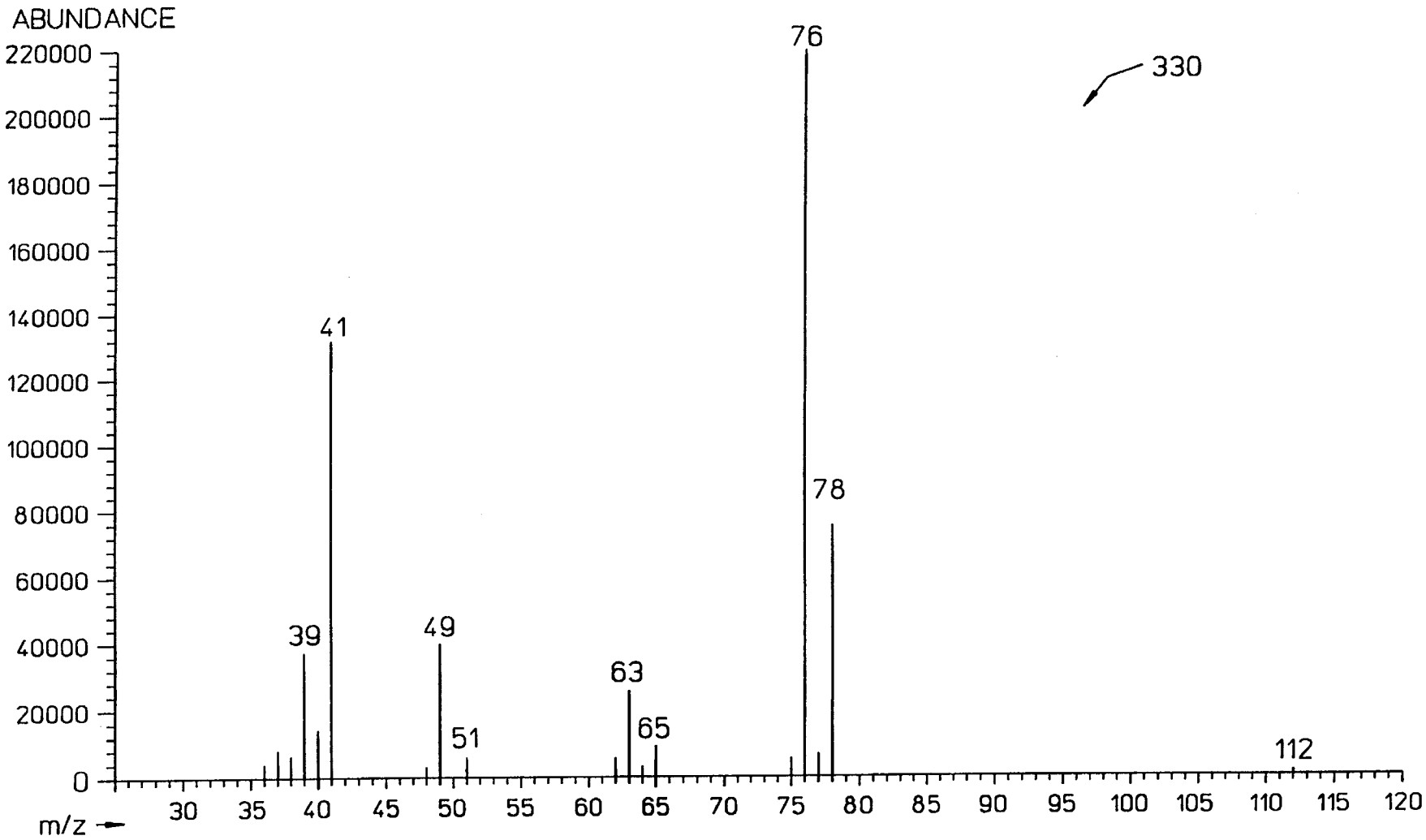
Figures 4A, 5:
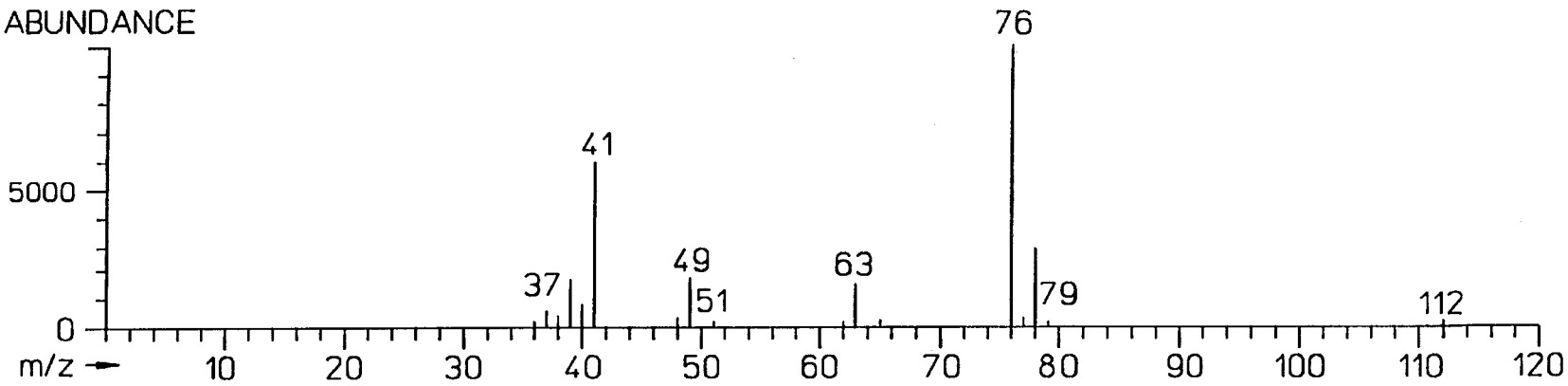
Figures 4B, 5:
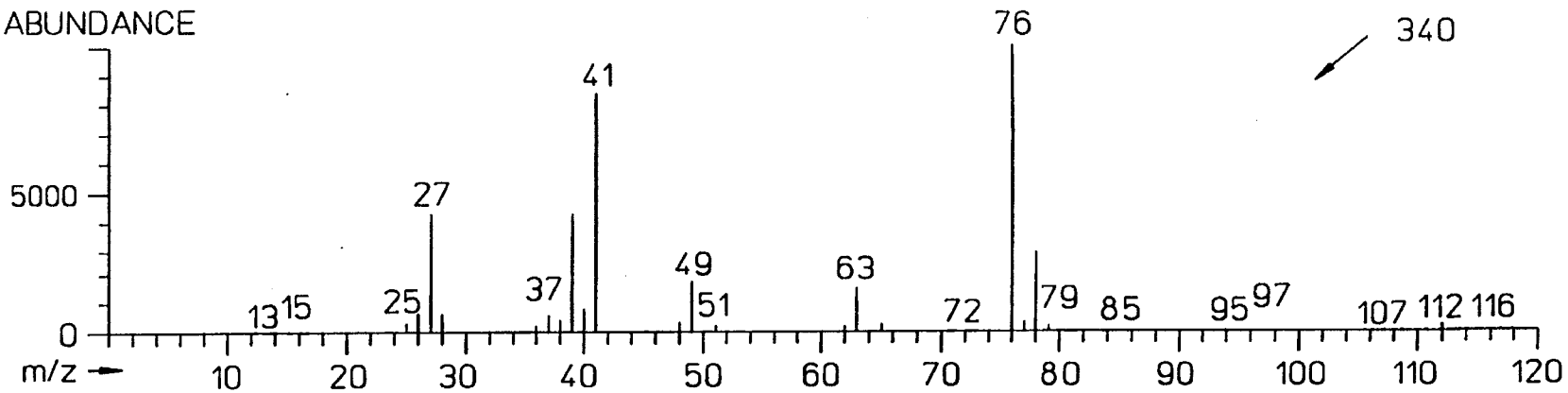
Figure 5:
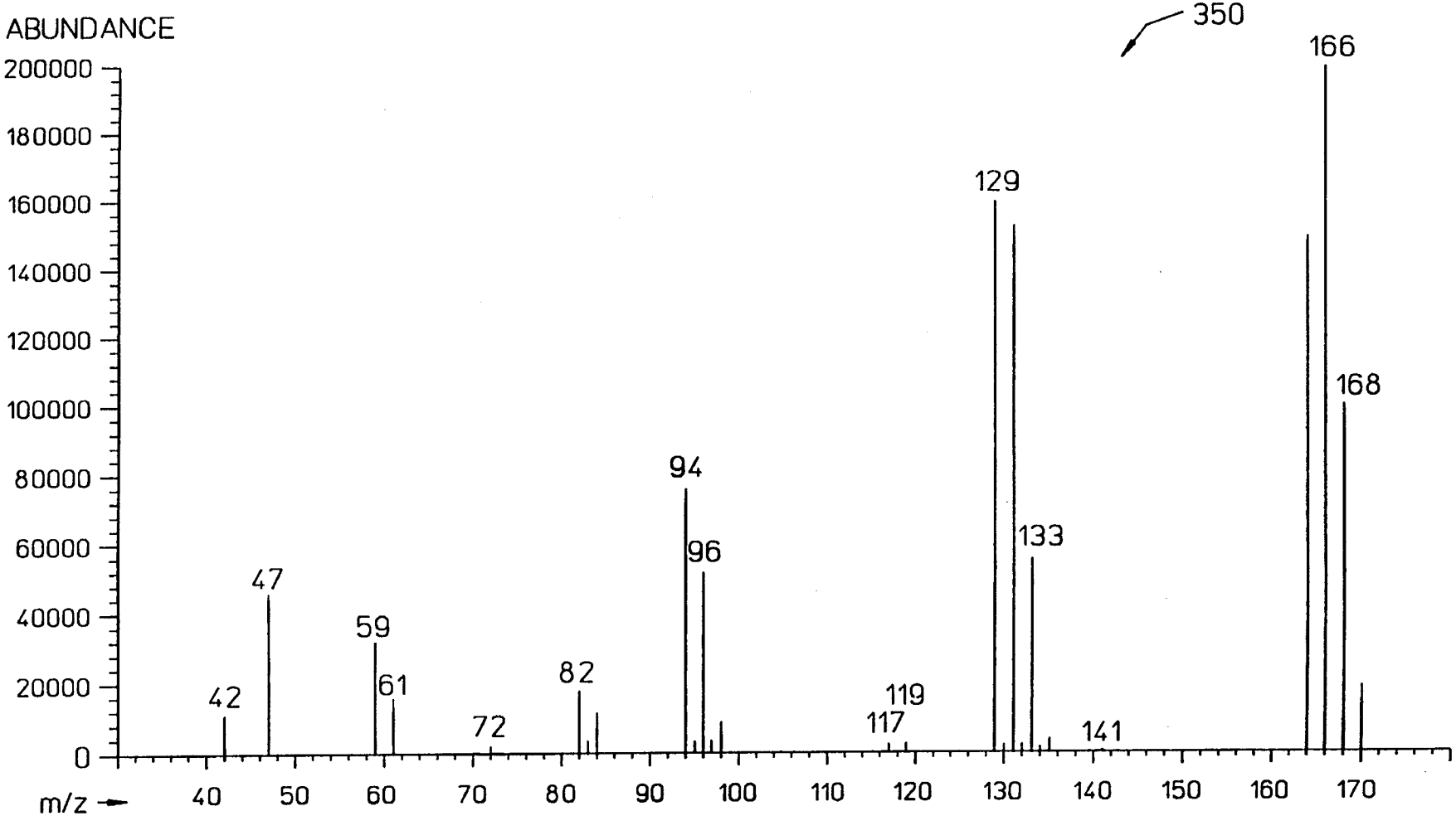
Figures 5, 6, 6A:
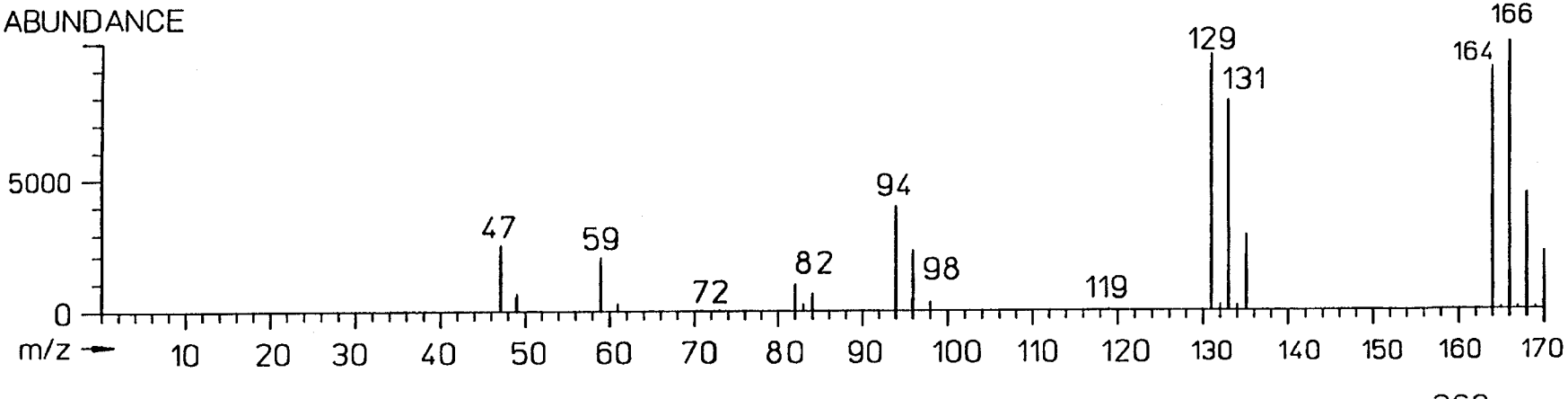
Figures 5, 6, 6B:
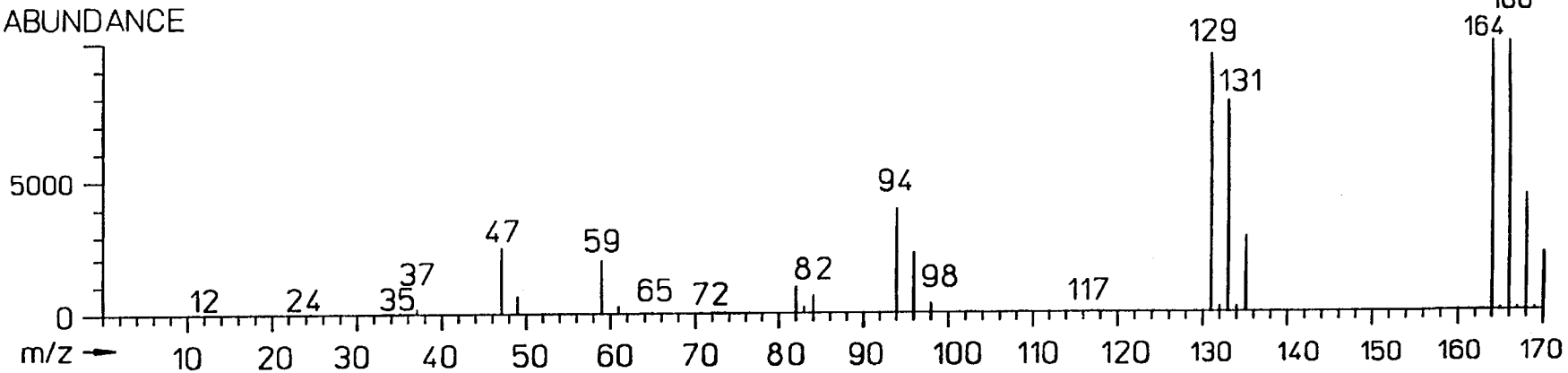
Figures 5, 6, 7:
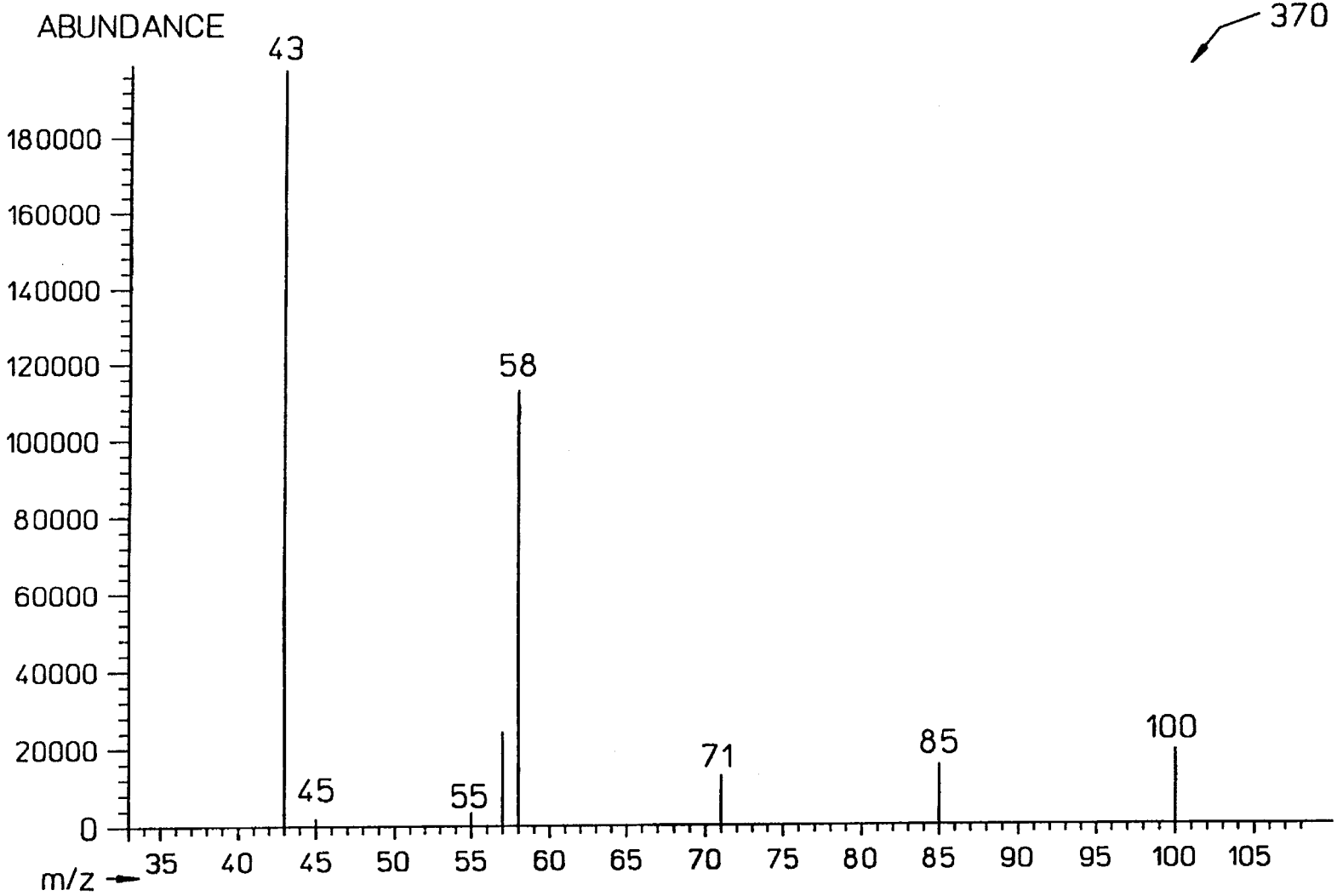
Figures 5, 6, 7, 8, 8A:
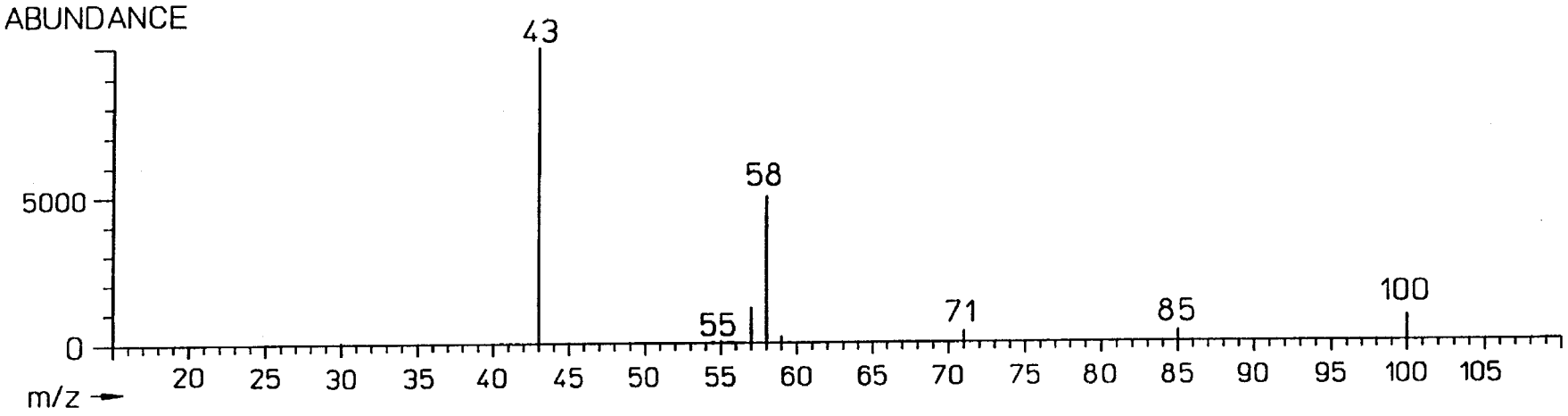
Figures 5, 6, 7, 8, 8B:
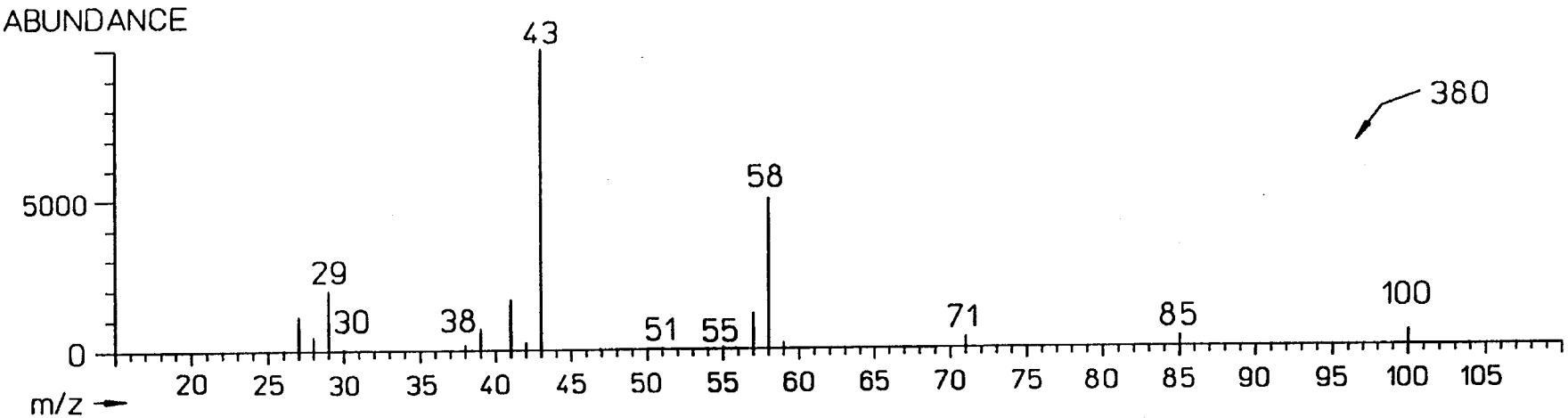
Figures 5, 6, 7, 8, 9:
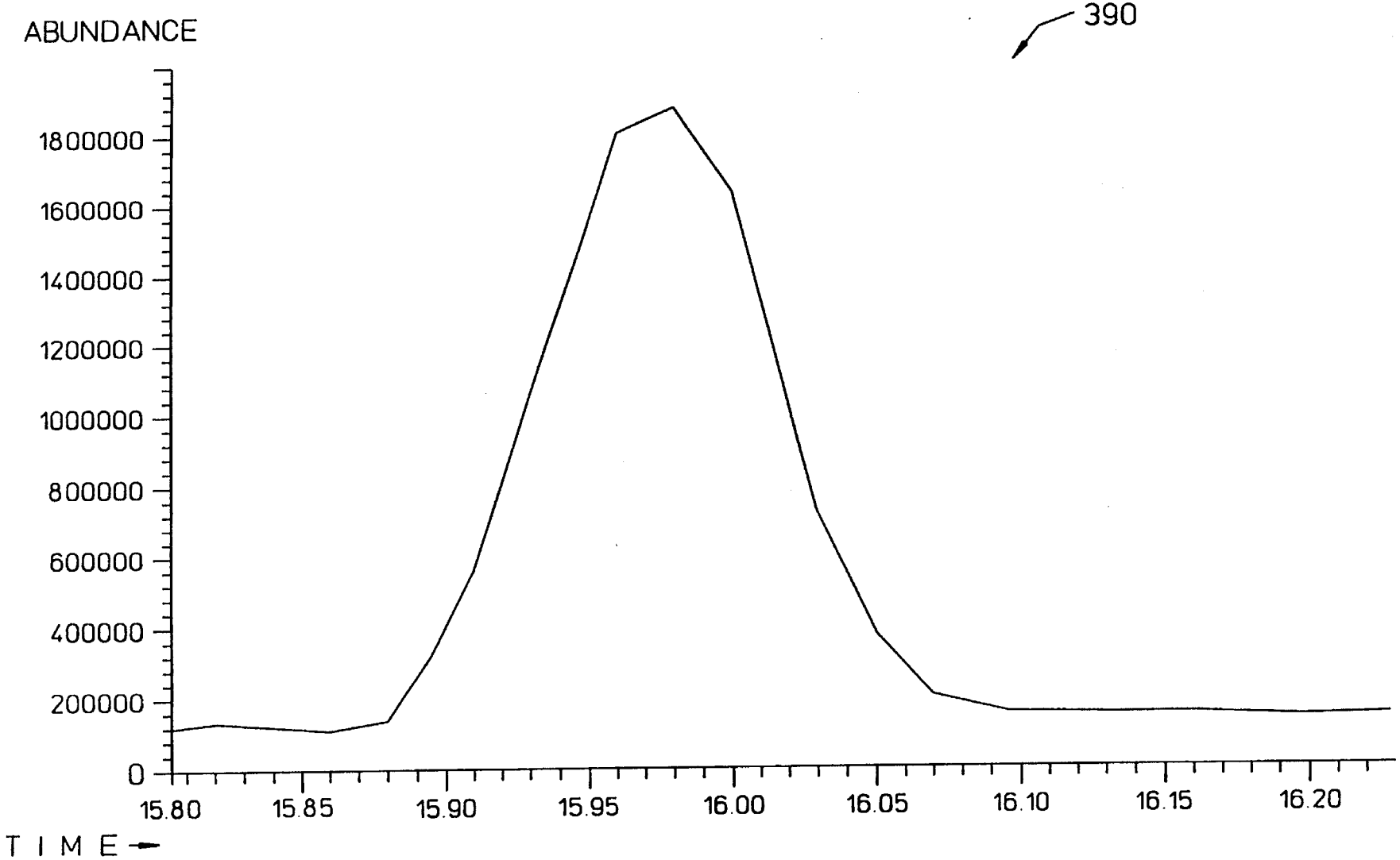
Figures 5, 6, 7, 8, 9, 10:
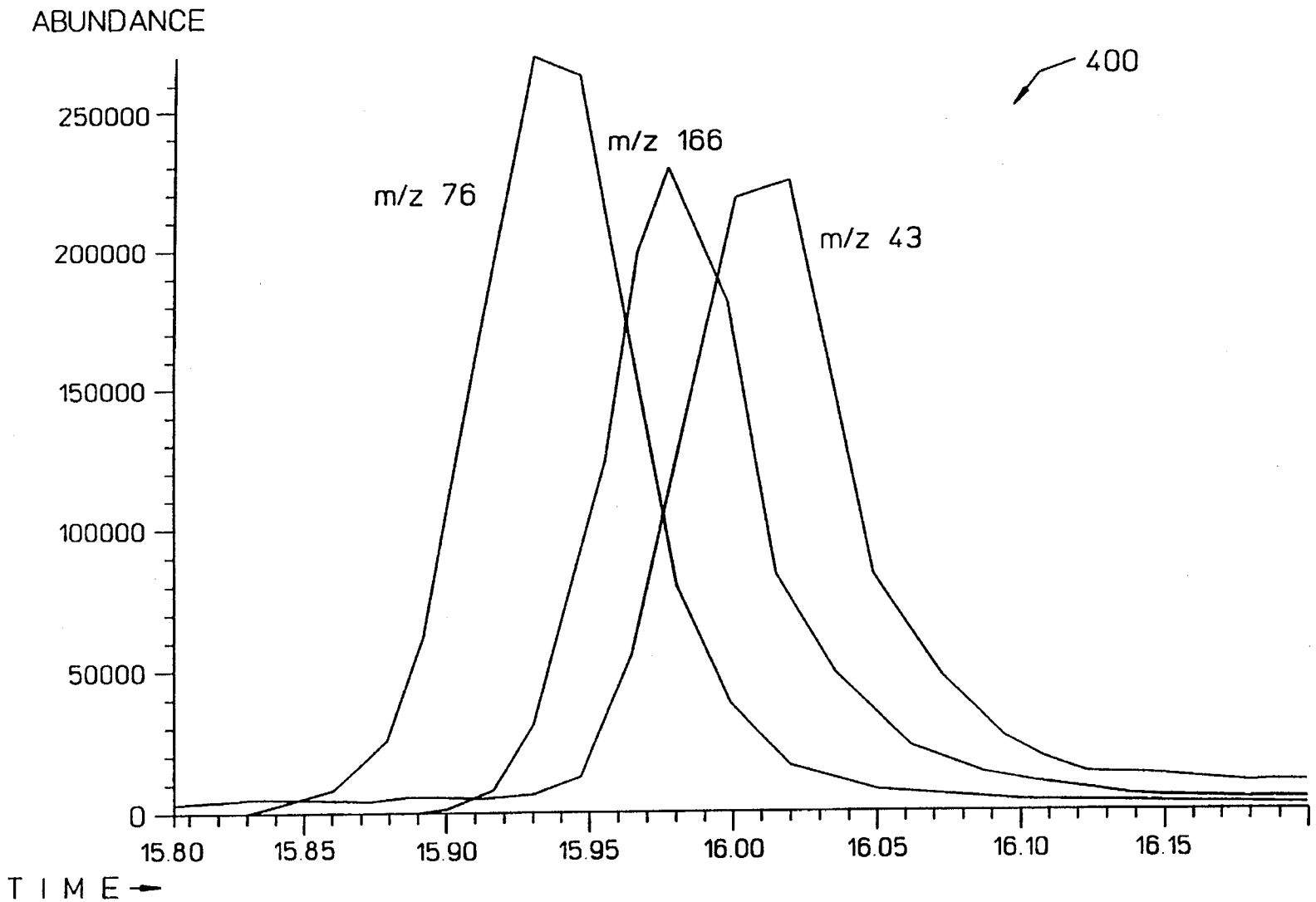

However, the power and utility of the invention is clearly apparent by the case illustrated in FIG. 5, including 5.1 through 5.10. A single peak FIG. 5.1, 310, without visible overlap is, in reality, three components. A manual search of the TIC apex FIG. 5.2, indicates tetrachloroethylene 330. However, the conventional analysis has no explanation for the two unmatched peaks. FIGS. 5.3 through 5–8 show the analysis of peaks at 15.94 minutes(5–3, 340) and the corresponding library Search (5–4, 340); an analysis at 15.98 minutes (FIG. 5.5, 350) and the library search (FIG. 5.6, 360); and an analysis at 16.02 minutes (FIG. 5.7, 370) and the library search (FIG. 5.8, 380). The TIC for 15.8 through 16.2 minutes is shown in FIG. 5.9, 390, and the three peaks extracted by the present invention are shown in FIG. 5.10, 400. The invention returns three spectra, 1,3 dichloro propane, tetrachloroethylene, and 2-hexanone. Conventional analysis could not identify these three components. This example demonstrates that the invention provides useful capabilities not found in prior methods.

We claim:

1. A mass spectrometric system comprised of:

(i) measuring device operable to measure the mass spectra of a sample which contains one or more compounds;

(ii) introduction device connected to the measuring device operable to introduce the sample into the measuring device;

(iii) control means electrically connected to the measuring device operable to control the operation of the measuring devices so as to measure one or more mass peaks of the sample;

(iv) data input/output device wherein said input/output device is electrically coupled to an analyzer device operable to analyze the mass peaks, wherein said analyzer device comprises:

a. storage means operable for storing data from the sample;

b. re-sorting means connected to the storage means operable for re-sorting sample data from chronological order, primarily, to ion-mass order and secondarily to chronological order within each ion-mass grouping;

c. determining means connected to the re-sorting means operable for determining local ion abundance maxima within each mass grouping;

d. sorting means connected to the determining means operable for sorting all local ion abundance maxima from the determining means chronologically; and e. partitioning means connected to the sorting means operable for partitioning all local maxima such that a set of deconvoluted spectra is obtained wherein each element of the set represents a distinct compound;

(v) comparison device operable for comparing deconvoluted spectra with stored standard reference spectra such that deconvoluted spectra are matched to at least one reference spectra; and (vi) matching means operable for matching the measured mass peaks to corresponding mass peaks of the stored spectrum of a target compound on a probabilistic basis, wherein the degree of matching is being determined with respect to a spectral matching criterion, the matching means being electrically coupled to the first and second storage means and to the measuring device, whereby, the target compound is identified as being present in the sample or as not being present therein in accordance with the spectral matching criterion.

2. A mass spectrometric system as in claim 1 wherein the analyzer further comprises deconvolution logic operating on measured mass peaks where the deconvolution logic comprises:

a) time calculating logic operable for calculating time centroids for each mass chromatogram maximum in the data range;

b) re-sort logic operable for resorting the mass spectral data file from chronological order to ion-mass order;

c) local peak logic, operable for selecting, by means of an integrator, local peaks (maximums) for each ion; measured by the measuring means mass spectra;

d) local maximum sorting logic operable for sorting local maximum chronologically; and e) partitioning logic operable for partitioning all local maximums such that a set of spectra is obtained wherein each spectra represents an identifiable compound.

3. A method of analysis of mass spectrometric data comprising the steps of:

a) receiving a sample containing one or more compounds;

b) obtaining sample data;

c) re-sorting sample data to ion-mass order;

d) selecting local maxima (for each ion-mass) from ion-mass order data;

e) re-sorting sample data to chronological order; and f) identifying each compound within the sample using the mass order/chronological order sample data.

* * * * *